United States Patent [19]

Hollyday et al.

[11] 4,152,041

[45] May 1, 1979

[54] HYBRID FILTER HEADER

[75] Inventors: Robert D. Hollyday, Hershey; Douglas W. Glover, Harrisburg, both of Pa.

[73] Assignee: AMP Incorporated, Harrisburg, Pa.

[21] Appl. No.: 878,972

[22] Filed: Feb. 17, 1978

[51] Int. Cl.[2] ..... H01R 13/20; H01R 13/66

[52] U.S. Cl. ..... 339/147 P

[58] Field of Search ..... 200/51.1; 339/111, 14 P, 339/74 R, 91 R, 147 R, 147 C, 147 P, 177 E

[56] References Cited

U.S. PATENT DOCUMENTS

| | | | |
|---|---|---|---|
| 2,944,241 | 7/1960 | Londell, Jr. | 339/74 R |
| 3,200,355 | 8/1965 | Dahlen | 339/147 |
| 3,493,917 | 2/1970 | Glowacz | 339/74 R |
| 3,600,531 | 8/1971 | Hoegerl | 339/177 E |

*Primary Examiner*—Joseph H. McGlynn

*Assistant Examiner*—John S. Brown

*Attorney, Agent, or Firm*—Russell J. Egan

[57] ABSTRACT

A hybrid filter header is disclosed for use in electro-explosive devices to assure shorting of the contacts in a disconnected condition thereby avoiding accidental detonation of the explosive device. The subject hybrid filter header is mounted in a receptacle member of a connector and includes at least two pin contacts, each mounted in a respective filter sleeve and secured in a ground plane adopted to be forced fitted into the receptacle housing. The terminals are encompassed between a pair of locking spring members that effect shorting of the terminals to the ground plane in a disconnected condition. The mating plug member includes an insulated portion which spreads the spring members to disengage them from the terminals and to engage therewith in a locking relationship to hold the connector members together.

6 Claims, 3 Drawing Figures

HYBRID FILTER HEADER

BACKGROUND OF THE INVENTION

1. The Field Of The Invention

The present invention relates to an improved hybrid filter header assembly and in particular to an assembly for providing RFI/EMI filtering and ground protection to circuits such as those used to arm electro-explosive devices.

2. The Prior Art

It is necessary to provide electro-explosive devices with protective means to prevent the accidental detonation of the device and the attendant harm and damage which may occur through such detonation. An example of such device is the means currently contemplated for actuating air bags and other passive restraint systems in the automotive industry. These devices are provided with circuitry which, upon actuation of the device in response to an impact exceeding a predetermined level, discharge a gas to inflate the bag. Clearly it would not be in the best interest to have such bags inflating prematurely and in particular that they not inflate during the process of installation and/or maintenance.

SUMMARY OF THE INVENTION

The subject hybrid filter header includes a ground plane adapted to be force fitted into a receptacle housing of a connector, at least one filtered terminal mounted in the ground plane and a locking spring secured to the ground plane and biased to normally engage the terminal in a disengaged condition of the associated plug member. The locking spring is removed from a grounding engagement with the terminal by an insulative portion of a mating plug member upon engagement of the members and serves to lockingly secure the mating members together.

It is therefore an object of the present invention to provide RFI/EMI filtering and grounding protection to circuits of various configurations of header devices and in particular to electro-explosive devices to prevent the accidental detonation thereof.

It is a further object of the present invention to produce a hybrid filter header which will have the terminals thereof grounded in a disconnected condition and in which the grounding means will serve to lockingly secure mated connector members together.

It is a further object of the present invention to produce an improved hybrid filter header which can be readily and economically produced.

Means for accomplishing the foregoing objects and other advantages which will become apparent to those skilled in the art are set forth in the following description taken with reference to the accompanying drawings.

DETAILED DESCRIPTION OF THE PREFERRED EMBODIMENT

Figure 1:
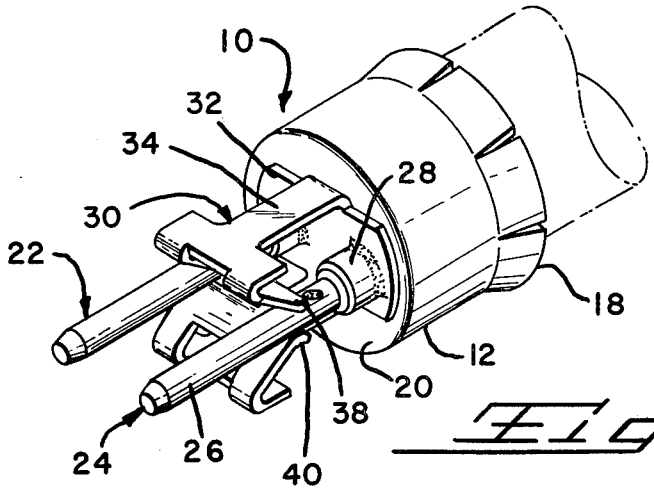
FIG. 1 is a perspective view of the subject hybrid filtered header.

The subject hybrid filtered header 10 includes a ground plane 12 profiled to be force fitted into an appropriate bore 14 in a connector housing 16, a receptacle in this case. For this purpose the ground plane 12 is provided on its rear extension with a plurality of outwardly directed lance-like projections 18 which engage in the walls of the bore 14. The ground plane 12 also includes a front face 20. A plurality of filtered terminals 22, 24 are mounted in the face of the ground plane. Each filtered terminal includes a pin contact 26 inserted into the hollow interior diameter of a sleeve filter 28. The pin contact 26 is electrically connected to the inner diameter of the filter while the outer diameter of the filter is electrically connected to the ground plane 12. A spring member 30 is also secured to the face of the ground plane by a base portion 32. A pair of resilient arms 34, 36 extend in cantilever fashion from the base 32 and have inwardly directed transverse flanges 38, 40, respectively, on the free ends thereof. The flanges 38, 40 normally engage opposite sides of the pin contacts 22, 24, as shown in FIGS. 1 and 2.

The mating connector member 42, a plug, includes a like member of receptacle contacts 44 each aligned for mating with a respective pin contact 22, 24. A profiled extension 46 of insulative material extends from the member 42 and includes a pair of rearwardly directed shoulders 48, 50 and forwardly directed cam surfaces 52, 54.

Figure 2:
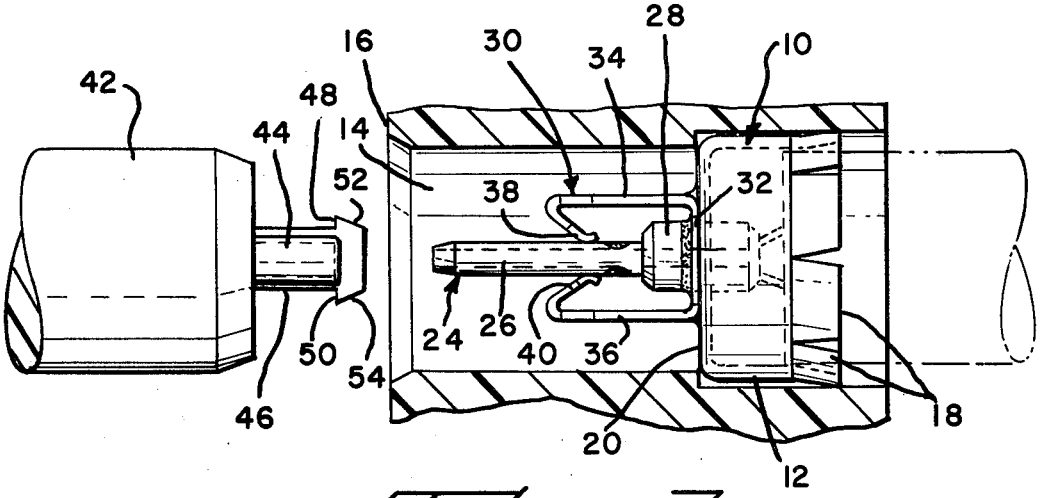
FIG. 2 is a side elevation, partially in section, of the subject hybrid filtered header mounted in a receptacle housing with a mating plug member exploded therefrom.
Figure 3:
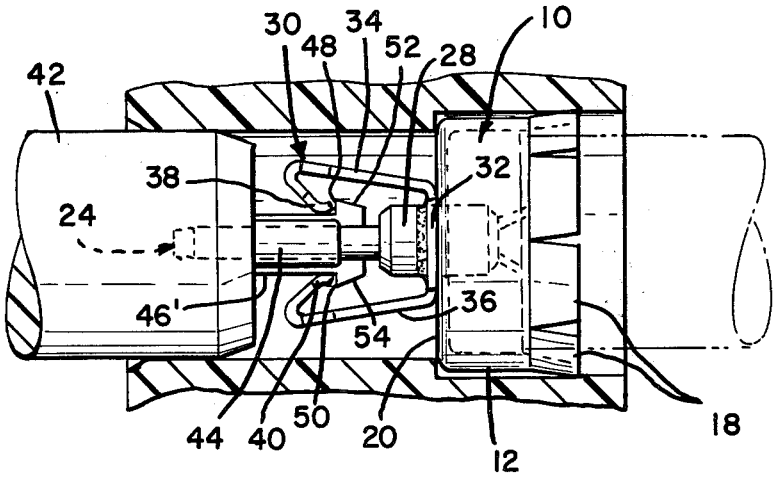
FIG. 3 is a view similar to FIG. 2 showing the subject hybrid filtered header after full mating of the associated connector members.

Upon mating of the connector members, the extension 46 first encounters the locking spring 30 with cam surfaces 52, 54 causing arms 34, 36, respectively to spread from the position shown in FIG. 2 to the position shown in FIG. 3. Thus the filtered terminals 22, 24 are disconnected from ground after mating with their respective receptacles 44. Further mating movement of the members causes flanges 38, 40 to latchingly engage with the respective shoulders 48, 50 thereby securing the connector members together.

The filters 28 employed with the present invention are preferably of the type disclosed in U.S. Pat Reissue No. 29,258, the disclosure of which is incorporated herein by reference.

It will be seen that the subject hybrid filter header will provide for shorting of the terminals at all times when the connector is unmated and yet will readily remove the short upon mating of the connector, while employing the shorting members in a useful fashion to provide locking of the mated connector members. Also it will be appreciated that the projection 42 is of such dimensions that the shorting will not be removed until the mating terminals are engaged.

The present embodiment may be subject to many modifications and changes without departing from the spirit or essential characteristics thereof. The present embodiment is therefore to be considered in all respects as illustrative and not restrictive of the scope of the invention.

What is claimed is:

1. A hybrid filtered header for an electrical connector providing RFI/EMI filtering and grounding protection to associated circuitry, said header comprising:

a ground plane adapted to be received in an aperture of one of a mating pair of connector members;

at least one filtered terminal mounted in said ground plane, said filtered terminal including a cylindrical filter sleeve electrically connected to said ground plane by its outer diameter and a terminal member electrically connected to the inner diameter of said filter sleeve;

a spring member having one end electrically connected to said ground plane with a resilient arm extending therefrom in cantilever fashion, said arm being biased so that the free end thereof normally engages said filtered terminal shorting it to ground; and a profiled projection of insulative material on a mating connector, said projection having a forwardly directed profile adapted to cam said spring member arm away from an associated terminal upon mating of said connector members.

2. A hybrid filtered header according to claim 1 further comprising:

at least one latching detent in said profiled projection adapted to latchingly engage with said arm of said spring member to lock said connector members together.

3. A hybrid filtered header according to claim 1 wherein said at least one filtered terminal comprises:

a pair of filtered terminals secured to said ground plane in parallel spaced relation;

said spring member arm having a transverse flange on the free end thereof, said flange engaging both said filtered terminals in the normal position; and said profiled projection lying intermediate of said filtered terminals and acting on said flange.

4. A hybrid filtered header according to claim 3 wherein said spring member comprises:

a pair of substantially parallel resilient arms extending from said ground plane in cantilever fashion, each said arm having a transverse flange on the free end thereof, said arms lying on opposite sides of said terminals with said flanges normally contacting said terminals.

5. A hybrid filtered header according to claim 1 wherein said ground plane is mounted in a receptacle member of a connector, and said terminal members are pin contacts.

6. A hybrid filtered header according to claim 1 wherein said spring member comprises:

a base portion secured to said ground plane;

a pair of resilient arms extending from said base portion in cantilever fashion in substantially parallel relation, each said arm having a transverse flange on a free end thereof, said flanges normally engaging said filtered terminals and latchingly engaging said profiled projection in a fully mated condition of said connector members.

* * * * *